US007095427B2

(12) United States Patent
Goto

(10) Patent No.: US 7,095,427 B2
(45) Date of Patent: Aug. 22, 2006

(54) IMAGE FORMING APPARATUS TRANSFER UNIT WITH TONER LAYER CHARGE-TO-THICKNESS RATIO

(75) Inventor: Takuya Goto, Tokyo (JP)

(73) Assignee: Oki Data Corporation, Tokyo (JP)

( * ) Notice: Subject to any disclaimer, the term of this patent is extended or adjusted under 35 U.S.C. 154(b) by 248 days.

(21) Appl. No.: 10/754,607

(22) Filed: Jan. 12, 2004

(65) Prior Publication Data

US 2004/0141772 A1 Jul. 22, 2004

(30) Foreign Application Priority Data

Jan. 14, 2003 (JP) ..... 2003-006137

(51) Int. Cl.
*B41J 2/385* (2006.01)
*G03G 15/00* (2006.01)

(52) U.S. Cl. ..... 347/140; 399/159

(58) Field of Classification Search ..... 347/140
See application file for complete search history.

(56) References Cited

U.S. PATENT DOCUMENTS 6,356,727 B1 * 3/2002 Ishii ..... 399/159
2005/0142472 A1 * 6/2005 Sekido et al. ..... 399/159

FOREIGN PATENT DOCUMENTS

JP 10-138549 5/1998

* cited by examiner

*Primary Examiner*—K. Feggins
*Assistant Examiner*—Julian D. Huffman
(74) *Attorney, Agent, or Firm*—Rabin & Berdo, PC

(57) ABSTRACT

A image forming apparatus includes a photosensitive body as an image bearing member having a surface layer. The surface layer includes a charge transport layer having the thickness from 10 μm to 20 μm. An exposing unit exposes the surface layer to the light to form latent image, and has a resolution greater than 600 dpi. A developing unit develops the latent image with toner so that a toner layer is formed on the photosensitive body. The toner layer formed on the photosensitive body includes two or three layers of toner particles. The electric charge Q (μC/g) of the toner layer per unit weight, the average thickness t (μm) of the toner layer, and the gap d (μm) between the smallest dots satisfy the following relationship:

$$50.4/d \leqq |Q/t| \leqq 10.0.$$

4 Claims, 7 Drawing Sheets

FIG.4

| TRANSFER VOLTAGE [V] \ Q/t | | 0.8 | 1.0 | 1.2 | 1.4 | 8.0 | 9.0 | 10.0 | 11.0 | 12.0 | 13.0 |
|---|---|---|---|---|---|---|---|---|---|---|---|
| 500 | TRANSFERABILITY | ○ | ○ | ○ | ○ | ○ | ○ | ○ | × | × | × |
| | REPEATABILITY | × | ○ | ○ | ○ | ○ | ○ | ○ | ○ | ○ | ○ |
| 1500 | TRANSFERABILITY | ○ | ○ | ○ | ○ | ○ | ○ | ○ | ○ | × | × |
| | REPEATABILITY | × | △ | ○ | ○ | ○ | ○ | ○ | ○ | ○ | ○ |
| 2500 | TRANSFERABILITY | ○ | ○ | ○ | ○ | ○ | ○ | ○ | ○ | △ | × |
| | REPEATABILITY | × | × | ○ | ○ | ○ | ○ | ○ | ○ | ○ | ○ |

FIG.5

| TRANSFER VOLTAGE [V] \ Q/t | | 1.6 | 1.8 | 2.0 | 2.2 | 2.4 | 9.0 | 10.0 | 11.0 | 12.0 | 13.0 |
|---|---|---|---|---|---|---|---|---|---|---|---|
| 500 | TRANSFERABILITY | ○ | ○ | ○ | ○ | ○ | ○ | ○ | × | × | × |
| | REPEATABILITY | × | △ | ○ | ○ | ○ | ○ | ○ | ○ | ○ | ○ |
| 1500 | TRANSFERABILITY | ○ | ○ | ○ | ○ | ○ | ○ | ○ | ○ | × | × |
| | REPEATABILITY | × | × | △ | ○ | ○ | ○ | ○ | ○ | ○ | ○ |
| 2500 | TRANSFERABILITY | ○ | ○ | ○ | ○ | ○ | ○ | ○ | ○ | △ | × |
| | REPEATABILITY | × | × | × | △ | ○ | ○ | ○ | ○ | ○ | ○ |

FIG.6

| THICKNESS OF CHARGE TRANSPORT LAYER | LEAKAGE | REPEATABILITY |
|---|---|---|
| 6 [μm] | OBSERVED | ○ |
| 8 [μm] | NONE | ○ |
| 10 [μm] | NONE | ○ |
| 20 [μm] | NONE | ○ |
| 22 [μm] | NONE | △ |

FIG.8

| TRANSFER VOLTAGE [V] \ Q/t | | 0.6 | 0.8 | 1.0 | 1.2 | 14.0 | 16.0 | 18.0 | 20.0 | 22.0 | 24.0 |
|---|---|---|---|---|---|---|---|---|---|---|---|
| 500 | TRANSFERABILITY | ○ | ○ | ○ | ○ | ○ | ○ | ○ | × | × | × |
| | REPEATABILITY | × | ○ | ○ | ○ | ○ | ○ | ○ | ○ | ○ | ○ |
| 1500 | TRANSFERABILITY | ○ | ○ | ○ | ○ | ○ | ○ | ○ | ○ | × | × |
| | REPEATABILITY | × | △ | ○ | ○ | ○ | ○ | ○ | ○ | ○ | ○ |
| 2500 | TRANSFERABILITY | ○ | ○ | ○ | ○ | ○ | ○ | ○ | ○ | △ | × |
| | REPEATABILITY | × | × | ○ | ○ | ○ | ○ | ○ | ○ | ○ | ○ |

FIG.9

| TRANSFER VOLTAGE [V] \ Q/t | | 1.2 | 1.4 | 1.6 | 1.8 | 2.0 | 9.0 | 18.0 | 20.0 | 22.0 | 24.0 |
|---|---|---|---|---|---|---|---|---|---|---|---|
| 500 | TRANSFERABILITY | ○ | ○ | ○ | ○ | ○ | ○ | ○ | × | × | × |
| | REPEATABILITY | × | △ | ○ | ○ | ○ | ○ | ○ | ○ | ○ | ○ |
| 1500 | TRANSFERABILITY | ○ | ○ | ○ | ○ | ○ | ○ | ○ | ○ | × | × |
| | REPEATABILITY | × | × | △ | ○ | ○ | ○ | ○ | ○ | ○ | ○ |
| 2500 | TRANSFERABILITY | ○ | ○ | ○ | ○ | ○ | ○ | ○ | ○ | △ | × |
| | REPEATABILITY | × | × | × | △ | ○ | ○ | ○ | ○ | ○ | ○ |

IMAGE FORMING APPARATUS TRANSFER UNIT WITH TONER LAYER CHARGE-TO-THICKNESS RATIO

BACKGROUND OF THE INVENTION

This invention relates to an image forming apparatus.

Conventionally, an electrophotography is used in an image forming apparatus such as a copier, a printer, a facsimile or a combined apparatus that combines the functions of copying, printing and faxing. Such an image forming apparatus performs processes of charging, exposure, developing, transferring, fusing and cleaning. As disclosed in Japanese Laid-Open patent publication No. 10-138549, the above described processes are respectively performed by a charging unit, an exposing unit, a developing unit, a transfer unit, a fixing unit and a cleaning unit.

The charging unit includes a conductive charging roller to which a direct voltage is applied. The charging roller contacts a photosensitive body to uniformly charge the photosensitive body. The exposing unit exposes the photosensitive body to the light so that a latent image is formed on the photosensitive body.

The developing unit includes a developing roller made of a resilient conductive material to which a direct voltage is applied, and a toner supplying roller that supplies the toner stored in a toner container to the developing roller. The developing roller contacts the photosensitive body so that the toner adheres to the latent image on the photosensitive body.

The transfer unit includes a transfer roller made of a semiconductive sponge to which a direct voltage is applied. The transfer roller contacts the bottom side of the recording sheet opposite to the photosensitive body so that the toner image is transferred from the photosensitive body to the recording sheet.

The cleaning unit includes a cleaning blade that contacts the surface of the photosensitive body to recover the residual toner that remains on the photosensitive body after the toner image is transferred to the recording sheet.

The conventional image forming apparatus has a resolution of 300 dpi. However, in order to meet the recent demand for improving image quality, the image forming apparatus is required to have a resolution of 600–1200 dpi or more, and therefore it is necessary to make improvements in the electrophotographic processes. Particularly, it is studied that the resolution can be improved by reducing the size of the toner particle or by reducing the thickness of a charge transport layer of the photosensitive body. However, it is difficult to reduce the size of the toner particles because of the difficulty in manufacturing. Moreover, it is difficult to reduce the thickness of the toner layer because the lifetime of the charge transport layer may be shortened with decreasing thickness.

Moreover, it is known that the scattering of the toner particles may occur when the toner particles are transferred from the photosensitive body to the recording sheet. The scattering of the toner particles is considered to be caused by electrostatic force acting on the toner particles at the transferring position. As the resolution increases, the gap between the smallest dots formed on the recording sheet decreases, and therefore the scattering of the toner particles may easily effect the image quality. For example, under the assumption that the allowable range of the scattering of the toner particle is within 150% of the size of the smallest dot, the scattering of the toner particles must be restricted within an area with the diameter of 126 μm when the resolution is 300 dpi.

However, if the resolution is 600 dpi, the scattering of the toner particles must be restricted within an area with the diameter of 63 μm. Further, if the resolution is 1200 dpi, the scattering of the toner must be restricted within an area with the diameter of 32 μm.

SUMMARY OF THE INVENTION

In order to solve the above described problems, an object of the present invention is to provide an image forming apparatus capable of restricting the scattering of toner particles at a transferring position, and capable of forming a high quality image with high resolution.

According to the invention, there is provided an image forming apparatus including an image bearing member having a surface layer. The surface layer includes a charge transport layer having the thickness from 10 μm to 20 μm. The image forming apparatus further includes an exposing unit that exposes the surface layer of the image bearing member to the light so as to form a latent image. The exposing unit has a resolution greater than or equal to 600 dpi. The image forming apparatus further includes a developing unit that develops the latent image on the image bearing member to form a toner layer that constitutes a toner image, and a transfer unit that transfers the toner image to a media. The electric charge Q (μC/g) of the toner layer per unit weight, the average thickness t (μm) of the toner layer, and the gap d (μm) between the smallest dots corresponding to the resolution of the exposing unit satisfy the following relationship:

$$50.4/d \leqq |Q/t| \leqq 10.0$$

With such an arrangement, the scattering of the toner particles at a transferring position can be restricted, and therefore it becomes possible to form a high quality image with high resolution even when a conventional image bearing member and a conventional toner are used.

BRIEF DESCRIPTION OF THE DRAWINGS

In the attached drawings:

FIG. 4 illustrates the experimental result on the repeatability of the dot shape and the transferability when the resolution is 600 dpi in the first embodiment;

FIG. 5 illustrates the experimental result on the repeatability of the dot shape and the transferability when the resolution is 1200 dpi in the first embodiment;

FIG. 6 illustrates the experimental result on the relationship between the repeatability of the dot shape and the thickness of a charge transport layer of a photosensitive body;

FIG. 8 illustrates the experimental result on the repeatability of the dot shape and the transferability when the resolution is 600 dpi in the second embodiment; and FIG. 9 illustrates the experimental result on the repeatability of the dot shape and the transferability when the resolution is 1200 dpi in the second embodiment.

DETAILED DESCRIPTION OF THE INVENTION

Embodiments of the present invention will be described with reference to the attached drawings.

FIRST EMBODIMENT

Figure 1:
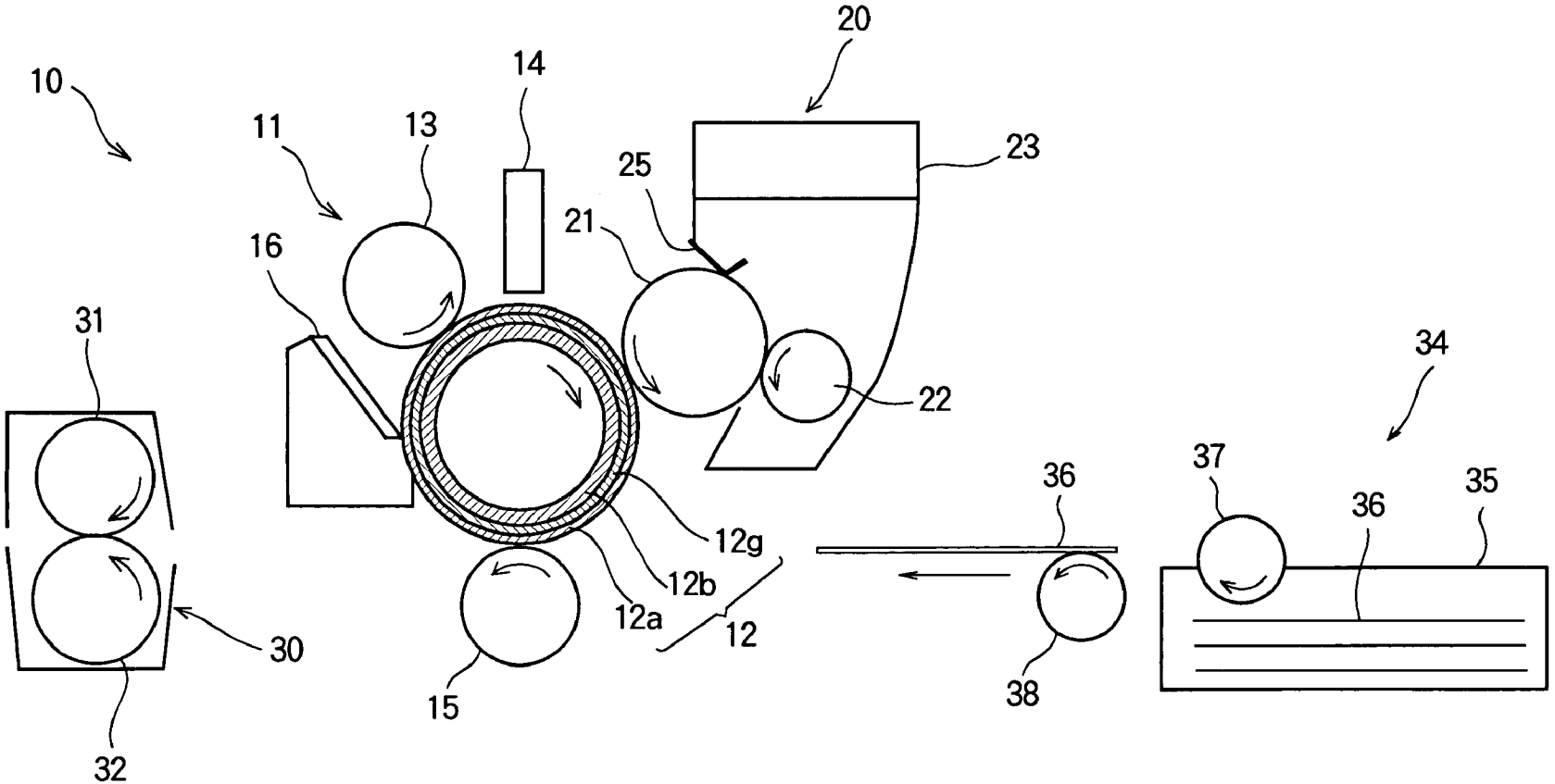
FIG. 1 is a side view illustrating the main part of an image forming apparatus according to the first embodiment of the present invention.

FIG. 1 illustrates the main part of an image forming apparatus 10 according to the first embodiment of the present invention.

The image forming apparatus 10 can be used as a printer, a copier, a facsimile or the like. The image forming apparatus 10 uses an electrophotographic technology and forms monochrome or color image on a recording sheet (media) 36 such as a printing paper, an envelope, an OHP sheet or the like.

Hereinafter, the description is made to the image forming apparatus 10 in the form of a printer that prints an image on the recording sheet 36 according to print signal received from an external device such as a personal computer or the like.

The image forming apparatus 10 includes an image forming unit 11 and a fixing unit 30. The image forming unit 11 forms a toner image on the recording sheet 36, and the fixing unit 30 fixes the toner image to the recording sheet 36. The image forming apparatus 10 can be constructed to form a monochrome image or a color image. In the case where the image forming apparatus 10 is constructed to form a color image, four image forming units 11 corresponding to Yellow (Y), Magenta (M), Cyan (C) and Black (K) are arranged along a feeding path of the recording sheet 36, i.e., from the right to the left in FIG. 1.

The image forming apparatus 10 includes a feeding mechanism 34. The feeding mechanism 34 includes a cassette 35 in which the recording sheets 36 are accommodated, a pickup roller 37 that picks up the recording sheet 36, and a feeding roller 38 that feeds the recording sheet 36 to the image forming unit 11. The image forming apparatus 10 further includes a driving mechanism including a not shown driving motor, gears, belts or the like for driving respective movable members (for example, rollers) of the image forming unit 11, the fixing unit 30 and the feeding mechanism 34. The image forming apparatus 10 further includes a not shown operation panel and control unit provided with a communication interface for controlling the operation of the image forming apparatus 10.

The image forming unit 11 includes a photosensitive body 12 as an image bearing member, a charging roller 13 as a charging unit for charging the surface of the photosensitive body 12, and an exposing unit 14 such as an LED (Light Emitting Diode) head or a laser emitting unit for exposing the surface of the photosensitive body 12 to the light so that a latent image is formed on the photosensitive body 12. The image forming unit 11 further includes a developing unit 20 that supplies toner (i.e., developer) to the surface of the photosensitive body 12 and develops the latent image to form a toner image, a transfer roller 15 as a transfer unit for transferring the toner image from the surface of the photosensitive body 12 to the recording sheet 36. The image forming unit 11 further includes a cleaning blade 16 as a toner removing unit for removing residual toner that remains on the surface of the photosensitive body 12 after the toner image is transferred to the recording sheet 36.

The photosensitive body 12 is in the form of a cylindrical drum and is driven by the driving mechanism and rotates clockwise in FIG. 1 at a constant rotational speed. The photosensitive body 12 includes a cylindrical conductive support 12*b* made of metal or the like, a charge generation layer 12*g* formed on the conductive support 12*b*, and charge transport layer 12*a* formed on the charge generation layer 12*g*. The charge transport layer 12*a* and the charge generation layer 12*g* form a surface layer. In this embodiment, the charge transport layer 12*a* is made of an organic photosensitive material and the thickness of the charge transport layer 12*a* is from 10 μm to 20 μm. In this regard, the thickness of the charge transport layer 12*a* means the thickness of a part of the charge transport layer 12*a* that functions to bear the toner image during the lifetime (i.e., the available time period) of the photosensitive body 12. The thickness of the charge transport layer 12*a* can be thicker than 20 μm or thinner than 10 μm after the lifetime expires or before the charge transport layer 12*a* is used in the image forming apparatus 10.

The exposing unit 14 can be an LED head including an array of LEDs and an array of SELFOC (trademark) lenses, or a laser emitting unit including a laser source and an imaging optical system. In this embodiment, the LED head is used as the exposing unit 14. The exposing unit 14 has a resolution of 600 dpi or 1200 dpi so that the gap between the smallest dots is 42 μm (for 600 dpi) or 21 μm (for 1200 dpi).

The charging roller 13 has a not shown metal shaft and a semiconductive rubber layer provided around the metal shaft. The charging roller 13 contacts or abuts against the photosensitive body 12 and rotates counterclockwise in FIG. 1.

The developing unit 20 uses a single component development technique, and includes a developing roller 21 that rotates counterclockwise in FIG. 1 to develop the latent image on the photosensitive body 12 with toner. The developing roller 21 includes a not shown metal shaft and a semiconductive rubber layer made of silicone rubber provided around the metal shaft. The surface roughness of the semiconductive rubber layer is from 1 μm to 15 μm. The developing unit 20 further includes a toner supply roller 22 that rotates counterclockwise in FIG. 1 and supplies toner to the developing roller 21. The toner supply roller 22 includes a not shown metal shaft and a semiconductive rubber layer made of silicone rubber provided around the metal shaft. The developing unit 20 further includes a developing blade 25 that regulates the thickness of the toner layer on the developing roller 21, and a toner cartridge 23 in which the toner is accommodated.

The transfer roller 15 is located at a transferring position where the toner image is transferred from the photosensitive body 12 to the recording sheet 36. The transfer roller 15 is urged against the photosensitive body 12 via the recording sheet 36 and rotates counterclockwise in FIG. 1.

The cleaning blade 16 contacts the surface of the photosensitive body 12 to remove the toner from the surface of the photosensitive body 12.

The fixing unit 30 is located at the downstream side of the image forming unit 11 along the feeding path of the recording sheet 36. The fixing unit 30 includes a heat roller 31 that rotates clockwise in FIG. 1 and a pressure roller 32 that rotates counterclockwise in FIG. 1. The heat roller 31 and the pressure roller 32 nip and heat the recording sheet 36 so that the toner image is fixed to the recording sheet 36.

The control unit controls the operations of the photosensitive body 12, the charging roller 13, the exposing unit 14, the developing roller 21, the toner supply roller 22, the transfer roller 15, the pickup roller 37, the feeding roller 38, the heat roller 31, the pressure roller 32 or the like. The control unit applies direct high voltage from a power source to the charging roller 13, the exposing unit 14, the developing roller 21, the toner supply roller 22, the developing blade 25, and the transfer roller 15 at predetermined timings. The feeding roller 37 is rotated by a not shown feeding motor.

The operation of the image forming apparatus 10 will be described.

When a print signal is sent from the external device such as a personal computer, the control unit drives the driving motor to rotate the photosensitive body 12, the charging roller 13, the transfer roller 15, the feeding roller 38, the pressure roller 32, the developing roller 21 and the toner supply roller 22 in the above described directions.

The control unit applies high direct voltage to the charging roller 13 so that the surface of the photosensitive body 12 (i.e., the surface of the charge transport layer 12*a*) is uniformly charged. Then, the exposing unit 14 exposes the surface of the photosensitive body 12 to the light according to the image information sent from the external device. As a result, the charge generation layer 12*g* is activated to generate the electric charge, so that the electric potential of exposed portion of the charge transport layer 12*a* substantially drops to zero. Consequently, a latent image is formed on the surface of the photosensitive body 12.

The control unit applies the direct voltages to the developing roller 21, the toner supply roller 22 and the developing blade 25, and the direct voltages have the same polarity as that applied to the charging roller 13. The toner is charged, and adheres to the latent image on the surface of the photosensitive body 12 by electrostatic force, with the result that the toner image is formed on the surface of the photosensitive body 12.

As the image forming unit 11 forms the toner image, the control unit drives the feeding motor to rotate the pickup roller 37 to feed the recording sheet 36 to the feeding path. Further, the control unit applies the high voltage to the transfer roller 15, at the time when the toner image on the photosensitive body 12 reaches the transferring position between the photosensitive body 12 and the transfer roller 15. The voltage applied to the transfer roller 15 is opposite to the charged toner on the photosensitive body 12. The charged toner is transferred from the surface of the photosensitive body 12 to the recording sheet 36.

The recording sheet 36 on which the toner image is transferred is fed to the fixing unit 30. In the fixing unit 30, the heat roller 31 and the pressure roller 32 apply heat and pressure to the recording sheet 36, with the result that the toner image is fixed to the recording sheet 36. The recording sheet 36 to which the toner image is fixed is discharged out of the image forming apparatus 10.

The residual toner that remains on the surface of the photosensitive body 12 is removed by the cleaning blade 16, so that the photosensitive body 12 is able to bear new toner image.

Figure 2A:
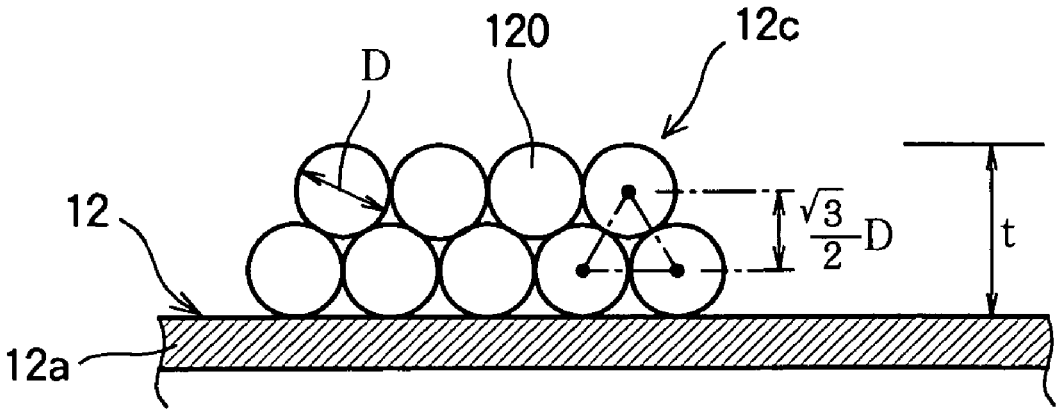
FIGS. 2A and 2B schematically illustrate examples of a toner layer formed on a photosensitive body of the image forming apparatus according to the first embodiment.
Figure 2B:
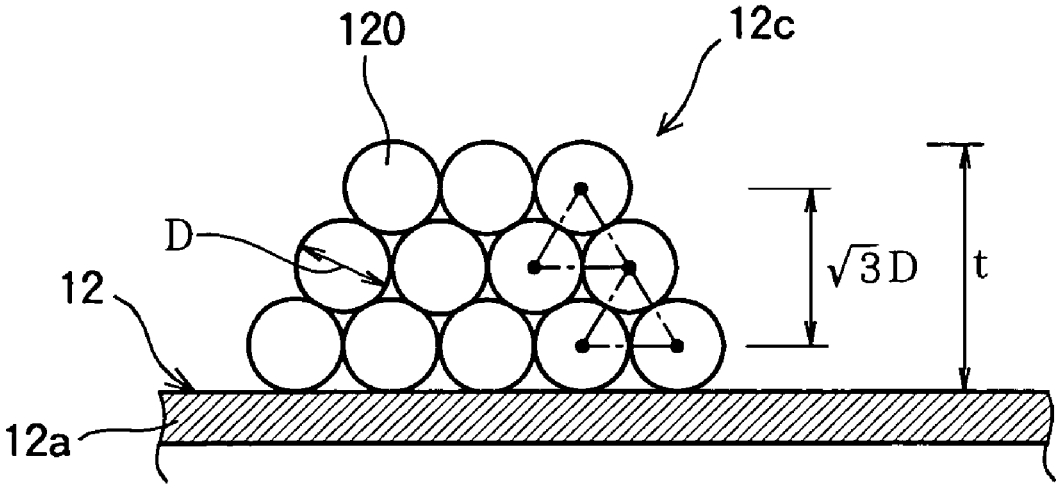

FIGS. 2A and 2B schematically illustrate the toner layer formed on the photosensitive body 12. The toner layer (denoted by reference 12*c* in FIGS. 2A and 2B) that constitutes the toner image on the photosensitive body 12 includes two or three layers of toner particles 120. When the toner layer 12*c* includes two layers of the toner particles 120 as schematically shown in FIG. 2A, the average thickness t of the toner layer 12*c* is expressed as follows:

$$D<t\leqq 1.866D \quad \text{(a1)}$$

where D represents the mean volume diameter of the toner particles 120 of the toner layer 12*c* on the photosensitive body 12. The upper limit in the relationship (a1) equals to $(1+\sqrt{3}/2)D$ geometrically determined based on the diameter D of the toner particles 120 as shown in FIG. 2A. The reason that there is a case where the average thickness t of the toner layer 12*c* is less than 1.866 D is that there is a clearance among toner particles 120 adjacent to each other. Similarly, when the toner layer 12*c* on the photosensitive body 12 includes three layers of the toner particles 120 as schematically shown in FIG. 7B, the average thickness t of the toner layer 12*c* is expressed as follows:

$$1.866D<t\leqq 2.732D \quad \text{(a2)}$$

The upper limit in the relationship (a2) equals to $(1+\sqrt{3})D$ geometrically determined based on the diameter D of the toner particles 120 as shown in FIG. 2B.

In the first embodiment, voltages applied to the developing roller 21, the toner supply roller 22 and the developing blade 25, the surface roughness of the developing roller 21 and the force with which the developing blade 25 is urged against the developing roller 21 are adjusted so that the toner layer 12*c* on the photosensitive body 12 includes two or three layers of the toner particles, i.e., the following relationship is satisfied:

$$D<t\leqq 2.732D \quad \text{(a3)}$$

In the first embodiment, in order to prevent the toner particles 120 from being scattering and to prevent the shapes of the dots from being disturbed, the adhesive force of the toner to the photosensitive body 12 is controlled. There are two kinds of forces acting on the toner particles 120 on the surface of the photosensitive body 12: an image force caused by the electric charge of the toner particles 120 of the toner layer 12*c*, and a coulomb force caused by the transfer voltage applied between the transfer roller 15 and the photosensitive body 12. When the electric charge of the toner layer 12*c* per unit weight is expressed as Q (μC/g) and the thickness of the toner layer 12*c* is expressed as t (μm), the image force is proportional to $(Q/t)^2$ and the coulomb force is proportional to Q.

The experimental result on the repeatability of the dot shape and the transferability will be described.

Figure 3:
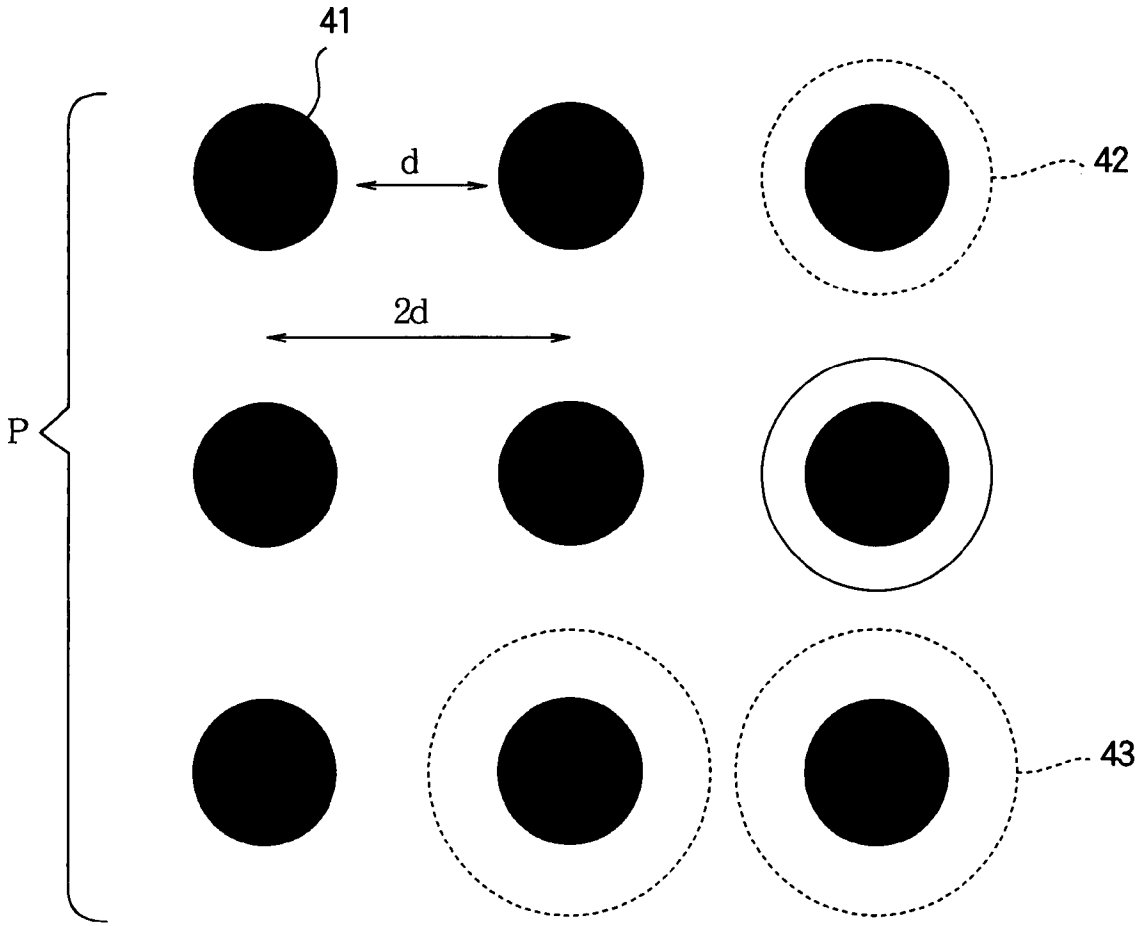
FIG. 3 is a schematic view of a print pattern used in an experiment in the first embodiment.

FIG. 3 illustrates a pattern including the smallest dots printed on the recording sheet 36 for evaluating the repeatability of the dot shape. FIG. 4 illustrates the experimental result on the repeatability of the dot shape and the transferability when the resolution of the exposing unit 14 is 600 dpi. FIG. 5 illustrates the experimental result on the repeatability of the dot shape and the transferability when the resolution of the exposing unit 14 is 1200 dpi.

The experiment is performed when the transfer voltage applied to the transfer roller 15 (whose polarity is opposite to the charged toner) is 500 V, 1500 V and 2500 V. Further, the value $|Q/t|$ is varied as a parameter. The image forming apparatus 10 forms a pattern including the smallest dots as shown in FIG. 3 on the recording sheet 36.

In the experiment, the electric charge Q (μC/g) of the toner layer 12*c* per unit weight is measured by "q/m test system 210 HS" manufactured by TREK Incorporated. The thickness t of the toner layer 12*c* is measured by a scanning laser microscope "ILM15" manufactured by Lasertec Corporation. The toner which is to be negatively charged is used.

The pattern shown in FIG. 3 is called as "1 by 1" and is used for evaluating the repeatability of the dot shape in this experiment. In FIG. 3, reference "d" denotes a gap between the smallest dots 41 formed on the recording sheet 36. The distance between centers of the adjacent dots 41 corresponds to 2 d.

The repeatability of the dot shape is determined by observing the scattering of the toner particles around the smallest dots 41. If the range of the scattering is within an area with diameter of 1.5 d as shown by broken line 42 in FIG. 3, the repeatability of the dot shape is acceptable (○). If the range of the scattering is within an area with diameter of 2.0 d as shown by broken line 43 in FIG. 3, the repeatability of the dot shape is somewhat acceptable (Δ). If the range of the scattering is not within the area with diameter of 2.0 d, the repeatability of the dot shape is not acceptable (X). This is because, if the toner scatters beyond the area with diameter of 2.0 d, the toner may reach the proximity of the adjacent dot 41, so that it becomes difficult to clearly separate the smallest dots 41 from each other.

The transferability is determined by measuring the transfer efficiency. If the transfer efficiency is greater than or equal to 90%, the transferability is acceptable (○). If the transfer efficiency is less than 90% bur greater than or equal to 75%, the transferability is somewhat acceptable (Δ). If the transfer efficiency is less than 75%, the transferability is not acceptable (X). This is because, if the transfer efficiency is less than 75%, a defect may be generated in the toner image transferred to the recording sheet 36 and it may be difficult to obtain a high quality image. Further, if the transfer efficiency is less than 75%, an amount of the toner removed by the cleaning blade 16 may increase and therefore the printing cost may increase.

As shown in FIG. 4, the range of the ratio |Q/t| for obtaining the acceptable repeatability and transferability when the resolution is 600 dpi (i.e., the gap d is 42 μm) and when the transfer voltage is from 500 V to 2500 V is expressed as follows:

$$1.2 \leqq |Q/t| \leqq 10.0 \quad \text{(b1)}$$

As shown in FIG. 5, the range of the ratio |Q/t| for obtaining the acceptable repeatability and transferability when the resolution is 1200 dpi (i.e., the gap d is 21 μm) and when the transfer voltage is from 500 V to 2500 V is expressed as follows:

$$2.4 \leqq |Q/t| \leqq 10.0 \quad \text{(b2)}$$

In the relationships (b1) and (b2), the upper limit of the ratio |Q/t| is so determined that the acceptable transferability is obtained, i.e., the transfer efficiency is greater than 90%. The lower limit of the ratio |Q/t| is so determined that the acceptable repeatability is obtained.

When the lower limit of the ratio |Q/t| in the relationship (b1) is multiplied by the gap d (42 μm) between the smallest dots 41 for the resolution of 600 dpi, the following relationship is obtained:

$$1.2 \times 42 = 50.4 \quad \text{(b3)}$$

Similarly, when the lower limit of the ratio |Q/t| in the relationship (b2) is multiplied by the gap d (21 μm) between the smallest dots 41 for the resolution of 1200 dpi, the following relationship is obtained:

$$2.4 \times 21 = 50.4 \quad \text{(b4)}$$

According to the relationships (b3) and (b4), it is understood that the lower limit of the ratio |Q/t| is inversely proportional to the gap d between the smallest dots 41.

According to the relationships (b1) through (b4), when the exposing unit 14 has the resolution greater than 600 dpi, it is possible to correctly form the smallest dots 41 and to obtain sufficient transferability when the following relationship (b5) is satisfied:

$$50.4/d \leqq |Q/t| \leqq 10.0 \quad \text{(b5)}$$

on condition that the magnitude of the transfer voltage applied to the transfer roller 15 (whose polarity is opposite to the charged toner) is from 500 V to 2500 V.

Next, the experimental result on the relationship between the thickness of the charge transport layer 12*a* of the photosensitive body 12 and the repeatability of the dot shape.

In this embodiment, the thickness of the charge transport layer 12*a* of the photosensitive body 12 is from 10 μm to 20 μm. When the thickness of the charge transport layer 12*a* is thinner than 10 μm, the charge transport layer 12*a* can not keep sufficient electric charge and may cause a discharge, i.e., an electric leakage. When the thickness of the charge transport layer 12*a* is thicker than 20 μm, the latent image can not be correctly formed in the exposing process, and therefore the repeatability of the dot shape decreases, with the result that the toner scatters beyond the area with diameter of 1.5 d around the smallest dots 41 (FIG. 3).

FIG. 6 illustrates an experimental result on the relationship between the thickness of the charge transport layer 12*a* of the photosensitive body 12 and the repeatability of the dot shape. The thickness of the charge transport layer 12*a* is varied from 6 μm to 22 μm on condition that the ratio |Q/t| is 10.0 and the transfer voltage is 2500 V. FIG. 6 also illustrates whether the electric leakage occurs.

According to FIG. 6, it is understood that the acceptable repeatability is obtained when the thickness of the charge transport layer 12*a* is thinner than or equal to 20 μm. Further, it is understood that the electric leakage does not occur when the thickness of the charge transport layer 12*a* is thicker than or equal to 8 μm. Considering that the charge transport layer 12*a* has a sufficient durability when the charge transport layer 12*a* is thicker than or equal to 10 μm, the preferable range of the thickness of the charge transport layer 12*a* is from 10 μm to 20 μm.

As described above, according to the first embodiment of the present invention, it is possible to form a high quality image with high resolution when the electric charge Q of the toner particles of the toner layer 12*c* on the photosensitive body 12 and the thickness t of the toner layer 12*c* satisfy the above-described relationship (b5).

The electric charge Q and the thickness t can be adjusted by varying the voltages applied to the developing roller 21, the toner supply roller 22 and the developing blade 25, the surface roughness of the developing roller 21 and the force applied to the developing blade 25 urged against the photosensitive body 12. Thus, it is possible to form a high quality image with high resolution greater than 600 dpi even when the conventional toner and the conventional photosensitive body 12 are used.

SECOND EMBODIMENT

Figure 7A:
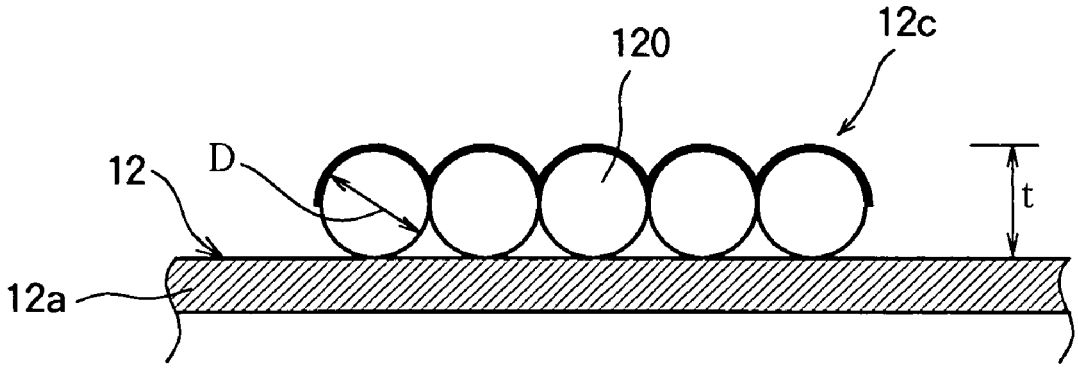
FIG. 7A schematically illustrates a toner layer formed on a photosensitive body of an image forming apparatus according to the second embodiment.
Figure 7B:
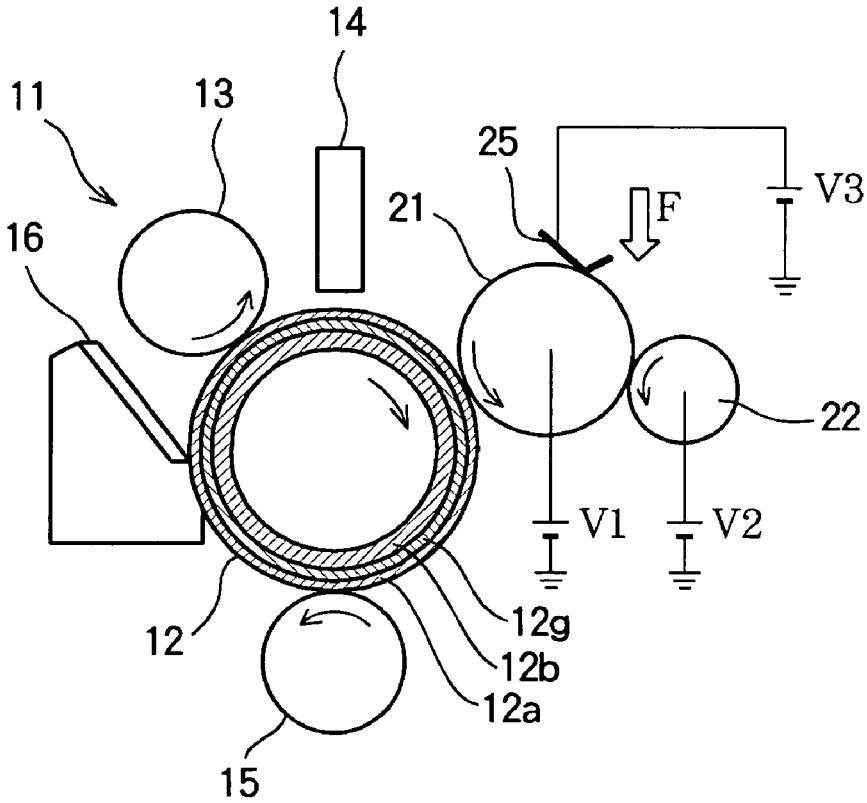
FIG. 7B illustrates an image forming unit of the image forming apparatus according to the second embodiment.

FIG. 7A schematically illustrates a toner layer formed in the image forming apparatus according to the second embodiment.

The second embodiment is different from the first embodiment in that the toner layer 12*c* on the photosensitive body 12 includes single-layered toner particles 120 as schematically shown in FIG. 7A. In other words, the average thickness t of the toner layer 12*c* on the photosensitive body 12 is equal to or less than the mean volume diameter D of the toner particles 120 of the toner layer 12*c*. The reason that there is the case where the average thickness of the toner layer 12*c* is less than the mean volume diameter D of the toner particles 120 is that there is a clearance among the toner particles 120.

FIG. 7B illustrates the image forming unit 11 of the image forming apparatus of the second embodiment. Voltages V1, V2 and V3 applied to the developing roller 21, the toner supply roller 22 and the developing blade 25, the surface roughness of the developing roller 21 and the force F with which the developing blade 25 is urged against the developing roller 21 are adjusted so that the toner layer 12*c* includes the single-layered toner particles 120, i.e., the average thickness t of the toner layer 12*c* is equal to or less than the mean volume diameter D of the toner particles 120. Other structure and operation of the image forming apparatus according to the second embodiment are the same as those of the first embodiment (FIG. 1).

The experimental result on the repeatability of the dot shape and the transferability will be described.

FIG. 8 illustrates the experimental result on the repeatability of the dot shape and the transferability when the resolution of the exposing unit 14 is 600 dpi. FIG. 9 illustrates the experimental result on the repeatability of the dot shape and the transferability when the resolution of the exposing unit 14 is 1200 dpi.

The experiments shown in FIGS. 8 and 9 are performed when the transfer voltage applied to the transfer roller 15 (whose polarity is opposite to the charged toner) is 500 V, 1500 V and 2500 V. In the experiment, the pattern including the smallest dots (FIG. 3) is used, and the ratio |Q/t| is varied as a parameter. The electric charge Q (μC/g) of the toner is measured by "q/m test system 210 HS" manufactured by TREK Incorporated. The thickness t of the toner layer is measured by scanning laser microscope "ILM15" manufactured by Lasertec Corporation. The toner which is to be negatively charged is used.

As was described in the first embodiment, the repeatability of the dot shape is determined by observing the scattering of the toner particles around the smallest dots 41. If the range of the scattering is within an area with diameter of 1.5 d, the repeatability of the dot shape is acceptable. If the range of the scattering is within an area with diameter of 2.0 d, the repeatability of the dot shape is somewhat acceptable. If the range of the scattering is not within the area with diameter of 2.0 d, the repeatability of the dot shape is not acceptable. The transferability is determined by measuring the transfer efficiency. If the transfer efficiency is greater than or equal to 90%, the transferability is acceptable. If the transfer efficiency is less than 90% bur greater than or equal to 75%, the transferability is somewhat acceptable. If the transfer efficiency is less than 75%, the transferability is not acceptable.

As shown in FIG. 8, the range of the ratio |Q/t| for obtaining the acceptable repeatability and transferability when the resolution is 600 dpi (i.e., the gap d is 42 μm) and when the transfer voltage is from 500 V to 2500 V is expressed as follows:

$$1.0 \leqq |Q/t| \leqq 18.0 \quad \text{(b6)}$$

As shown in FIG. 9, the range of the ratio |Q/t| for obtaining the acceptable repeatability and transferability when the resolution is 1200 dpi (i.e., the gap d is 21 μm) and when the transfer voltage is from 500 V to 2500 V is expressed as follows:

$$2.0 \leqq |Q/t| \leqq 18.0 \quad \text{(b7)}$$

In the relationships (b6) and (b7), the upper limit of the ratio |Q/t| is so determined that the acceptable transferability is obtained, i.e., the transfer efficiency is greater than 90%. The lower limit of the ratio |Q/t| is so determined that the acceptable repeatability is obtained.

When the lower limit of the ratio |Q/t| in the relationship (b6) is multiplied by the gap d (42 μm) between the smallest dots 41 for there solution of 600 dpi, the following relationship is obtained:

$$1.0 \times 42 = 42.0 \quad \text{(b8)}$$

Similarly, when the lower limit of the ratio |Q/t| in the relationship (b7) is multiplied by the gap d (21 μm) between the smallest dots 41 for the resolution of 1200 dpi, the following relationship is obtained:

$$2.0 \times 21 = 42.0 \quad \text{(b9)}$$

According to the relationships (b8) and (b9), it is understood that the lower limit of the ratio |Q/t| is inversely proportional to the gap d between the smallest dots 41.

Accordingly, in the image forming apparatus of the second embodiment, it is possible to correctly form the smallest dots 41 and to obtain sufficient transferability when the following relationship (b10) is satisfied:

$$42.0/d \leqq |Q/t| \leqq 18.0 \quad \text{(b10)}$$

on condition that the magnitude of the transfer voltage applied to the transfer roller 15 (whose polarity is opposite to the charged toner) is from 500 V to 2500 V.

In the second embodiment, the toner layer 12*c* includes the single-layered toner particles 120, and therefore all of the toner particles 120 of the toner layer 12*c* directly adhere to the charge transport layer 12*a* of the photosensitive body 12. Accordingly, the image force becomes stronger, and the repulsive force between the toner particles 120 does not arise in the direction perpendicular to the surface of the charge transport layer 12*a*. Thus, all of the toner particles 120 of the toner layer 12*c* uniformly adhere to the charge transport layer 12*a*. As a result, in the second embodiment, the scattering of the toner particle 120 at the transferring position is smaller than in the first embodiment.

Moreover, in the second embodiment, all of the toner particles 120 of the toner layer 12*c* directly contact the recording sheet 36. Therefore, the van derWaals' force arises between the recording sheet 36 and the toner particles 120, with the result that the transferability is higher than in the first embodiment.

In the second embodiment, the adjustable range of the ratio |Q/t| expressed by the relationship (b10) is wider than the adjustable range in the first embodiment. Thus, it is possible to widely vary the settings of the developing unit 20, for example, the voltages applied to the developing roller 21, the toner supply roller 22 and the developing blade 25, the surface roughness of the developing roller 21 and the toner supply roller 22. Accordingly, the convenience in design of the developing unit 20 is enhanced.

In the above described first and second embodiments, the developing unit 20 uses a single component development technique. However, the above described advantages of the first and second embodiments can be obtained even when the developing unit 20 uses a double component development technique, a magnetic single component development technique or non-contact development technique.

Further, in the first and second embodiments, rubber layers of the developing roller 21 and the toner supply roller 22 are made of silicone rubber. However, the rubber layers of the developing roller 21 and the toner supply roller 22 can be made of urethane rubber, styrene butadiene copolymer rubber, acrylonitrile butadiene copolymer rubber, acryl rubber, epichlorohydrin rubber, EPDM (ethylene propylene diene monomer) rubber, or NBR (acrylonitrile butadiene rubber). In addition, the combination of two or more of these materials can be used as the rubber layers of the developing roller 21 and the toner supply roller 22.

Moreover, in the first and second embodiments, the charging roller 13 is used as a charging unit. However, the charging roller 13 can be replaced by a corona charger, a non-contact type charging roller or the like.

Furthermore, in the first and second embodiments, the toner which is to be negatively charged is used as developer. However, it is possible to use the toner which is to be positively charged.

Additionally, in the first and second embodiments, the transfer roller 15 is used as a transfer unit. However, it is possible to use belt-type transfer unit.

Moreover, it is possible that the surface layer of the photosensitive body 12 includes one layer or more in addition to the charge transport layer 12*a* and the charge generation layer 12*g*.

While the preferred embodiments of the present invention have been illustrated in detail, it should be apparent that modifications and improvements may be made to the invention without departing from the spirit and scope of the invention as described in the following claims.

What is claimed is:

1. An image forming apparatus comprising:

an image bearing member having a surface layer, said surface layer including a charge transport layer, said charge transport layer having a thickness from 10 μm to 20 μm;

an exposing unit that exposes said surface layer of said image bearing member to light so as to form a latent image, said exposing unit having a resolution greater than or equal to 600 dpi;

a developing unit that develops said latent image on said image bearing member to form a toner layer that constitutes a toner image, and a transfer unit whose transfer voltage is in the range from 500 V to 2500 V, said transfer unit transferring said toner image to a media, wherein an electric charge Q (μC/g) of said toner layer per unit weight, an average thickness t (μm) of said toner layer, and a gap d (μm) between smallest dots corresponding to said resolution of said exposing unit satisfy the following relationship:

$$50.4/d \leqq |Q/t| \leqq 10.0.$$

2. The image forming apparatus according to claim 1, wherein the average thickness t of said toner layer and a mean volume diameter D of said toner particles of said toner layer satisfy the following relationship:

$$D < t \leqq 2.732D.$$

3. An image forming apparatus comprising:

an image bearing member having a surface layer, said surface including a change transport layer, said charge transport layer having a thickness from 10 μm to 20 μm;

an exposing unit that exposes said surface layer of said image bearing member to light so as to form a latent image, said exposing unit having a resolution greater than or equal to 600 dpi;

a developing unit that develops said latent image on said image bearing member to form a toner layer that constitutes a toner image; and a transfer unit whose transfer voltage is in the range from 500 V to 2500 V, said transfer unit transferring said toner image to a media, wherein said toner layer includes single-layered toner particles, and an electric charge Q (μC/g) of said toner layer per unit weight, an average thickness t (μm) of said toner layer, and a gap d (μm) between smallest dots corresponding to said resolution of said exposing unit satisfy the following relationship:

$$42.0/d \leqq |Q/t| \leqq 18.0.$$

4. The image forming apparatus according to claim 3, wherein the average thickness of said toner layer is less than or equal to a mean volume diameter of said toner particles of said toner layer.

* * * * *